US005924890A

United States Patent [19]

Morin et al.

[11] Patent Number: 5,924,890

[45] Date of Patent: Jul. 20, 1999

[54] ELECTRICAL CONNECTOR HAVING A VIRTUAL INDICATOR

[75] Inventors: Scott F. Morin, Ft. Lauderdale, Fla.; Peter S. Altmaier, San Jose, Calif.

[73] Assignee: The Whitaker Corporation, Wilmington, Del.

[21] Appl. No.: 08/918,880

[22] Filed: Aug. 26, 1997

Related U.S. Application Data

[60] Provisional application No. 60/024,924, Aug. 30, 1996.

[51] Int. Cl.[6] ..... H01R 13/658

[52] U.S. Cl. ..... 439/490; 439/607

[58] Field of Search ..... 439/488, 490, 439/676, 619, 717

[56] References Cited

U.S. PATENT DOCUMENTS

| | | | |
|---|---|---|---|
| 4,058,759 | 11/1977 | Halfhill | 322/13 |
| 4,063,147 | 12/1977 | Hatanaka et al. | 323/22 |
| 4,217,538 | 8/1980 | Ziemacki | 322/29 |
| 4,262,242 | 4/1981 | Glennon | 322/28 |
| 4,291,286 | 9/1981 | Wagner | 333/166 |
| 4,310,816 | 1/1982 | Fuller | 333/156 |
| 4,323,863 | 4/1982 | Weber | 333/109 |
| 4,354,168 | 10/1982 | Fay | 333/156 |
| 4,398,161 | 8/1983 | Lamb et al. | 333/156 |
| 4,737,703 | 4/1988 | Hayakawa | 323/213 |
| 4,968,928 | 11/1990 | Heider | 323/275 |
| 4,978,317 | 12/1990 | Pocrass | 439/490 |
| 4,992,761 | 2/1991 | Seely et al. | 333/118 |
| 5,122,079 | 6/1992 | Locati | 439/417 |
| 5,146,385 | 9/1992 | Misencik | 439/490 |
| 5,239,559 | 8/1993 | Branch et al. | 375/36 |
| 5,362,991 | 11/1994 | Samela | 327/540 |
| 5,480,319 | 1/1996 | Vlakancic | 439/490 |
| 5,601,451 | 2/1997 | Driones et al. | 439/490 |
| 5,613,873 | 3/1997 | Bell, Jr. | 439/490 |
| 5,639,267 | 6/1997 | Loudermilk | 439/607 |
| 5,700,157 | 12/1997 | Chung | 439/490 |
| 5,704,802 | 1/1998 | Loudermilk | 439/490 |

OTHER PUBLICATIONS

Working Draft SCSI–3 Parallel Interface, X3T9.2, 855 D, Revision 12b, Jun. 7, 1993, pp. 1–65.

MeBtechnik, Rausch–Und Storfrei Messen, Elektor Dec. 1993, pp. 76–79 & pp. 1–8.

Amphenol, RJHS High Speed RJ–45 Modular Jack.

Maxconn, Modular Jack Connectors, MLJ Series.

*Primary Examiner*—Hien Vu

*Attorney, Agent, or Firm*—Salvatore Anastasi

[57] ABSTRACT

The invention provides a modular jack receptacle connector (10) for mounting to a printed circuit board. Visual indicators (40) are provided along the mating face (24) of the modular jack receptacle connector (10). These visual indicators may be utilized for indicating various conditions either along the circuit board or between the modular jack receptacle jack connector (10) and an associated plug mated therewith. The visual indicators (40) are disposed on a flexible film circuit (42) in the modular jack receptacle connector (10) so as to minimize any electrical interference between the indicators and the communication signals passing through the connector (10).

5 Claims, 2 Drawing Sheets

ELECTRICAL CONNECTOR HAVING A VIRTUAL INDICATOR

This application claims the benefit of U.S. Provisional Application(s) No(s). 60/024,924, filed Aug. 30, 1996.

FIELD OF THE INVENTION

This invention relates to electrical connectors and more particularly to electrical connectors having a visual indicator.

BACKGROUND OF THE INVENTION

Modular jack receptacle connectors are well known in the telecommunications industry and have been adapted for mounting to printed circuit boards. These connectors are typically used for electrical connection between two electrical communication devices. In order to ensure that a proper connection has been made and therefore a link is created between the electrical communication devices, indicators are often incorporated into circuits on the printed circuit board. These indicators are typically light emitting diodes (LEDs) which are turned on when a circuit is completed between the mating connectors and the communication devices. Additionally LEDs can be mounted on the printed circuit board to indicate a number of other conditions including the passage of communication signals between the two communication devices, indication of power, or indication that an error in transmitting the signals has occurred.

In an effort to miniaturize printed circuit boards and save board real estate, LED indicators have been integrated into these connectors. An example of such a connector is disclosed in U.S. Pat. No. 4,978,317 to Pocrass which teaches a connector for receiving a plug having a visual indicator positioned within the front wall of the electrical connector housing. Incorporation of the indicator into the electrical connector eliminates the need for a separate location on the printed circuit board for mounting of such an indicator. The LED indicator is inserted into a recess of the electrical connector such that its electrical leads pass through the recess and connect to the printed circuit board. The indicator is then cemented into the recess or attached using an appropriate adhesive. The LEDs may also be molded into the electrical connector during the molding process of the housing.

A problem arises with such connectors because the LEDs generate electrical noise signals which interfere with the communication signals passing through the modular jack plug and receptacle connectors. As these connectors are used for ever increasing communication signal speeds, the noise interference by surrounding devices such as LEDs becomes more significant.

SUMMARY OF THE INVENTION

It is therefore an object of the invention to provide a modular jack receptacle connector having a visual indicator which is disposed in the connector so as to minimize electrical noise interference between such indicator and the communication signals passing through the modular jack receptacle connector.

The object of the invention has been achieved by providing a board mountable electrical connector having a light emitting device mounted on a flexible film circuit. The flexible film circuit is disposed in the electrical connector such that it carries electrical signals from the printed circuit board to the mating face of the electrical connector where the LEDs are mounted thereon for visual indication.

BRIEF DESCRIPTION OF THE DRAWINGS

The invention will now be described by way of example with reference to the accompanying figures of which.

DETAILED DESCRIPTION OF THE INVENTION

Figure 1:
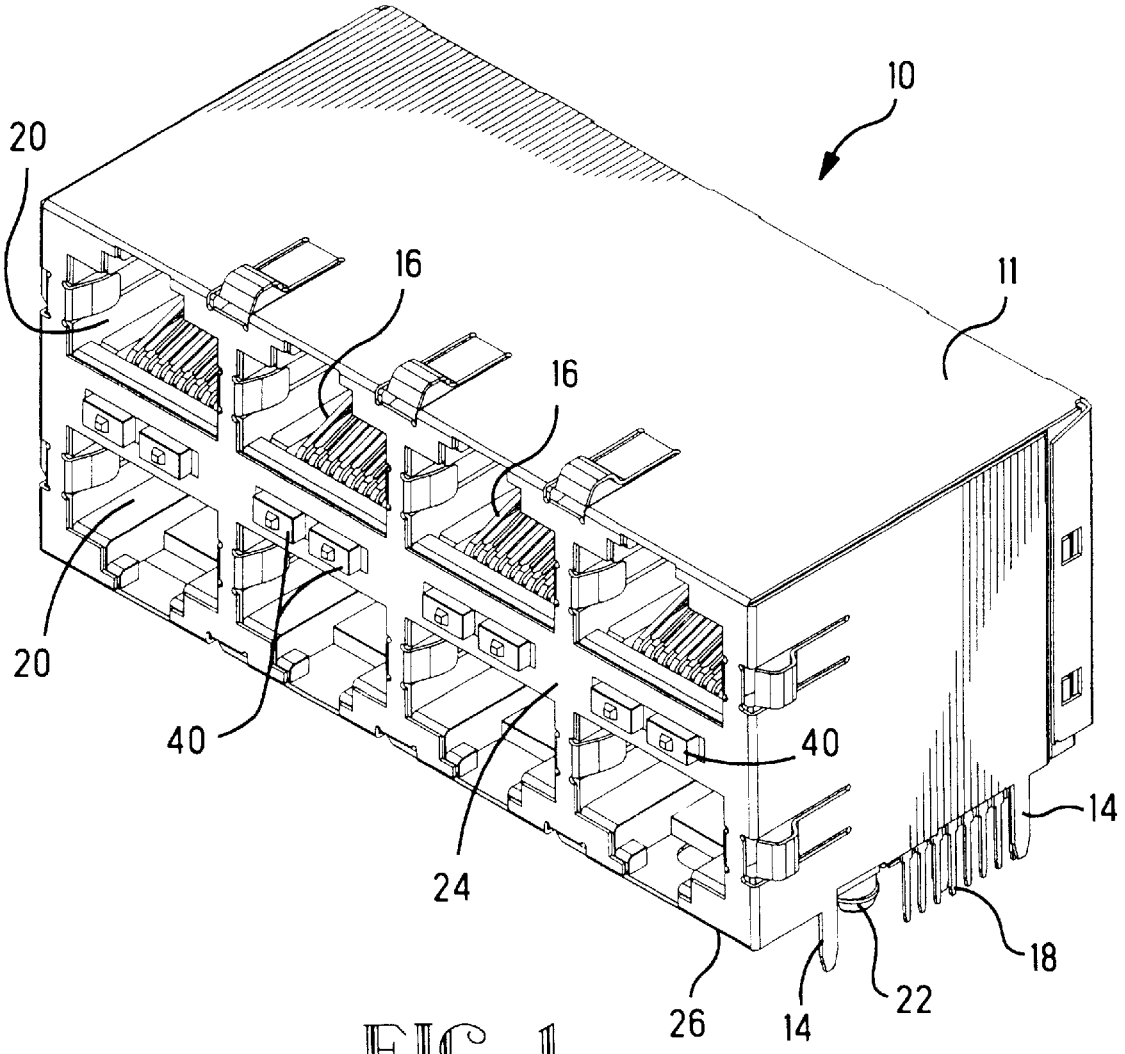
FIG. 1 shows a three dimensional view of the modular jack receptacle connector according to this invention.

The modular jack receptacle connector 10 will first be described generally with reference to FIG. 1. The modular jack receptacle connector 10 is designed to receive eight standard modular jack plugs (not shown). LED indicators 40 are provided on the mating face 24 of the modular jack receptacle connector 10. These indicators 40 may be utilized for indicating any number of conditions; for example, they may indicate that a complete connection has been made between the plug and the receptacle 10 or they may indicate that power is on, or they indicate that communication signals are passing between the connectors. The indicators 40 may also be color coded to indicate various conditions on either electrical printed circuit board or the electrical connector 10. Alignment posts 22 are provided along aboard mounting face 26 for proper alignment to guide holes on a printed circuit board (not shown). Standard modular jack receptacle signal contacts 16 are provided in each plug receiving cavity 20 for electrical connection to a plug which is inserted into each of the plug receiving openings 20. These signal contacts 16 exit the board mounting face 26 in the standard manner and have tails for mounting to the printed circuit board. The modular jack receptacle connector 10 is also provided with an electromagnetic interference (EMI) shield 11 which surrounds the outer surface of the housing 12 for protection against electromagnetic interference. The EMI shield 11 is connected to a printed circuit board through tabs 14 which enter plated openings in the printed circuit board.

Figure 2:
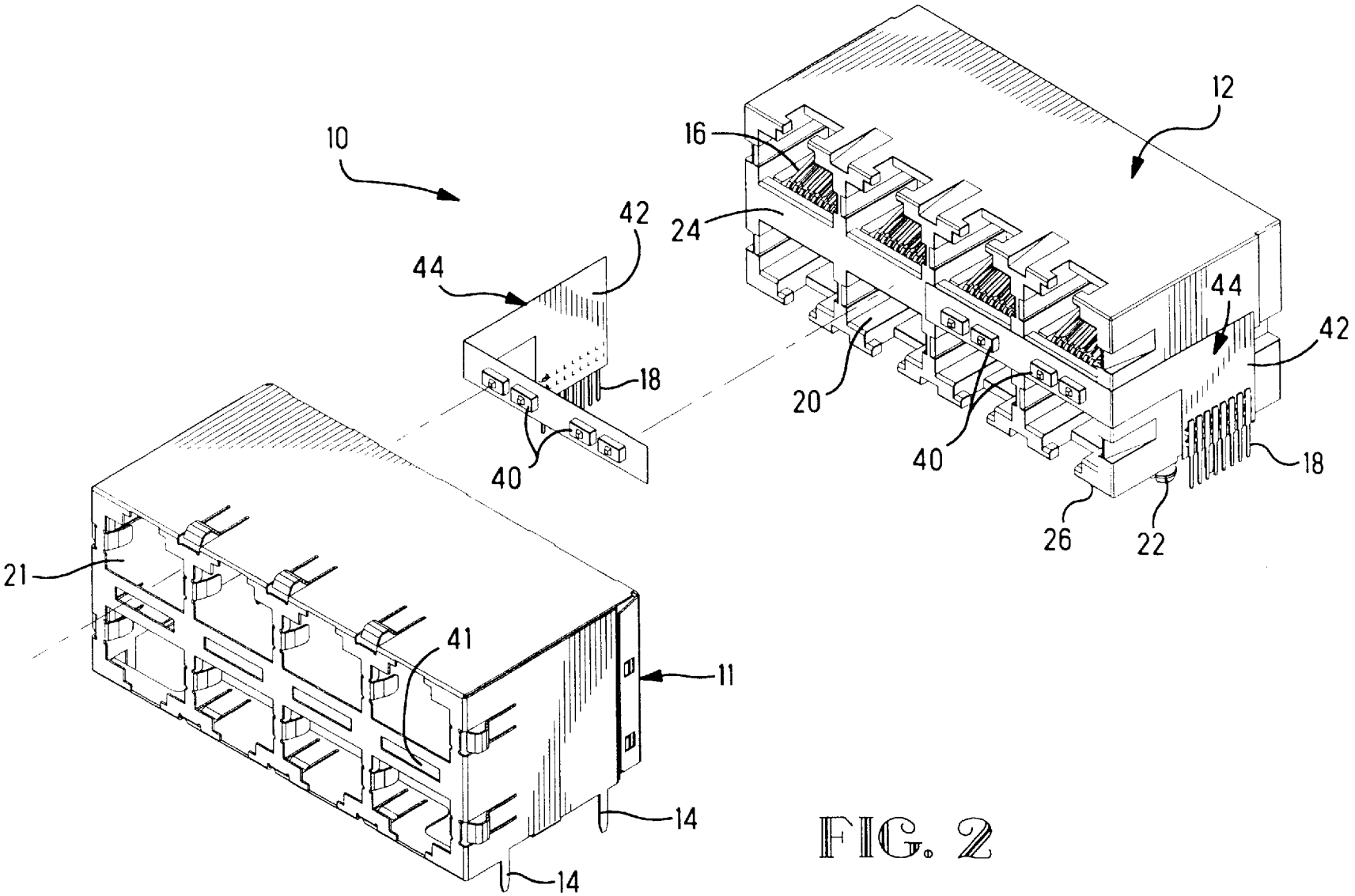
FIG. 2 shows an exploded three dimensional view of the modular jack receptacle connector according to this invention.

Each of the major components will now be described in greater detail with reference to FIG. 2. The modular jack receptacle connector 10 consists of an insulative housing 12 having a series of plug receiving openings 20 along a mating face and guideposts 22 along a board mounting face for guiding the housing 12 and securing the housing 12 to a printed circuit board. Electrical contacts 16 are disposed inside each plug receiving opening 20 for electrical connection to a plug inserted therein. These signal contacts 16 are inserted into the housing by standard means known in the industry and exit the board mounting face 26 for electrical connection to a printed circuit board.

A flexible film circuit 42 is disposed along the surface of insulative housing 12 and is provided with board mounting contact tails 18 proximate to the board mounting face 26. The flexible film circuit 42 is formed such that an electrical path is created from the board mounting face 26 to the mating face 24 of the insulative housing 12. LEDs 40 are mounted to the flexible film circuit 42 using standard surface mount technology (SMT) in the area of the flexible film 42 disposed on the mating face 24.

The EMI shield 11 surrounds the insulative housing 12 and is provided with openings 21 corresponding with each of a respective plug receiving opening 20 along the mating face 24. Openings 41 are also provided for receiving the LEDs 40 along the mating face 24.

The modular jack receptacle connector 10 is assembled by first inserting the electrical contacts 16 into the insulative housing 12. The flexible film circuit 42 is then formed as a subassembly 44 by connecting the board mounting contact tails 18 each to a respective circuit path of the flexible film circuit 42. The LEDs 40 are then surface mounted to respective electrical circuit paths of the flexible film circuit 42 and the flexible film circuit is formed in conformance with the shape of the path it is to follow along the outer surface of the insulative housing 12. This subassembly is then attached to the insulative housing 12 such that the board mounting pins 18 exit along the board mounting face 26 of the insulative housing and the LEDs 40 are disposed along the mating face 24 of the insulative housing 12 and aligned with openings 41 of the EMI shield 11. Alternatively, a film receiving area could be formed along the surfaces of the insulative housing 12 to receive and secure the flexible film circuit without the need for any adhesive. The EMI shield 11 is then placed over the insulative housing 12 and the flexible film circuit subassembly 44 to complete the assembly process. The modular jack receptacle connector 10 is then ready for mounting to a printed circuit board.

The advantage of this invention is that the LEDs 40 and their associated electrical paths to the printed circuit board through the flexible film circuit 42 are sufficiently spaced apart from the signal contacts 16 so as to minimize any electrical interference between the LEDs 40 and the electrical communication signals passing through contacts 16. It should be understood that while this invention is shown here embodied in an electrical connector having two rows of four stacked modular plug receiving openings 20, the invention may be applied to other configurations of such connectors, for example to a single plug receiving opening or to a single row of plug receiving openings or to a stacked connector having a plurality of plug receiving openings arranged in various row and column configurations. It should also be also understood that while the flexible film circuit subassembly 44 is shown here as being routed along the outer surface of the insulative housing 12. It may also be designed to pass through the insulative housing between rows and columns in order to achieve an optimal level of minimum interference between the LEDs 40 and the communication signals.

We claim:

1. An electrical connector having an insulative housing including a circuit board mounting face, a mating face, a cavity for receiving a mating connector, and contacts extending from the circuit board mounting face into the cavity, the electrical connector comprising:

a flexible film circuit having integral circuit traces, board contacts, and a light emitting device mounted on a front surface thereof and disposed along the mating face, the flex film circuit extending from the mating face to a printed circuit board and being electrically connected to the circuit board whereby electrical signals on the circuit board are transmitted through the flexible film circuit to the light emitting device.

2. An electrical connector as recited in claim 1 wherein the flexible film is disposed along outer surfaces of the insulative housing.

3. An electrical connector as recited in claim 1 wherein the flexible film is disposed along a path from the board mounting face to the mating face such that a distance between the contacts and the film is maximized.

4. An electrical connector as recited in claim 1 further comprising a shield member which substantially surrounds the insulative housing and the flexible film, the shield member having an opening for receiving the light emitting device.

5. An electrical connector 10 as recited in claim 1 further comprising a shield member 11 which substantially surrounds the insulative housing 12 and the flexible film 44, the shield member 11 having an opening 41 for receiving the light emitting device 40.

* * * * *